US008147568B2

(12) United States Patent
Caprotti et al.

(10) Patent No.: US 8,147,568 B2
(45) Date of Patent: Apr. 3, 2012

(54) STABILISED DIESEL FUEL ADDITIVE COMPOSITIONS

(75) Inventors: Rinaldo Caprotti, Oxford (GB); Russell M. Thompson, Witney (GB)

(73) Assignee: Infineum International Limited (GB)

( * ) Notice: Subject to any disclaimer, the term of this patent is extended or adjusted under 35 U.S.C. 154(b) by 1180 days.

(21) Appl. No.: 10/932,462

(22) Filed: Sep. 1, 2004

(65) Prior Publication Data

US 2005/0060929 A1 Mar. 24, 2005

(30) Foreign Application Priority Data

Sep. 5, 2003 (EP) ..... 03255551

(51) Int. Cl.
*C10L 1/12* (2006.01)
*C10L 1/18* (2006.01)
*C10L 1/24* (2006.01)

(52) U.S. Cl. ..... 44/354; 44/355; 44/356; 44/358; 44/361; 44/362; 44/363; 44/365; 44/366; 44/389; 44/403; 44/406; 44/418

(58) Field of Classification Search ..... 44/354, 44/355, 356, 358, 389, 403, 406, 418, 361, 44/362, 363, 365, 366
See application file for complete search history.

(56) References Cited

U.S. PATENT DOCUMENTS

| | | | | |
|---|---|---|---|---|
| 3,438,756 | A | 4/1969 | Lindstrom | 44/51 |
| 6,096,104 | A * | 8/2000 | Van den Neste et al. | 44/363 |
| 6,136,048 | A * | 10/2000 | Birchem et al. | 44/354 |
| 6,210,451 | B1 * | 4/2001 | Chopin et al. | 44/357 |
| 6,488,725 | B1 * | 12/2002 | Vincent et al. | 44/358 |
| 6,649,156 | B1 | 11/2003 | Chane-Ching | 424/70.9 |

FOREIGN PATENT DOCUMENTS

| | | | |
|---|---|---|---|
| EP | 0 671 205 | A2 | 9/1995 |
| FR | 2789601 | A1 | 8/2000 |
| GB | 2248068 | A | 3/1992 |
| WO | WO 02/02720 | A2 | 1/2002 |
| WO | WO0200812 | * | 1/2002 |

* cited by examiner

*Primary Examiner* — Cephia D Toomer

(57) ABSTRACT

A diesel fuel composition containing metallic additives that are stabilized against phase separation. The diesel fuel contains a colloidally dispersed or solubilized metal catalyst compound, which can be used for diesel particulate trap regeneration and, as a stabilizer, 5-1,000 ppm (weight) of an oil-soluble or oil-dispersible organic compound having a lipophilic hydrocarbyl chain having attached directly thereto at least two contiguous polar head functional groups, i.e., the functional groups are separated by no more than three carbon atoms. The diesel fuel composition is particularly suitable for use with diesel engines fitted with a particulate trap for emissions control.

10 Claims, No Drawings

STABILISED DIESEL FUEL ADDITIVE COMPOSITIONS

This invention relates to novel fuel additive compositions. More particularly, this invention relates to fuel compositions containing metallic additives which are stabilised against phase separation. Metallic additives are added to fuels since they are especially effective in improving the performance of particulate traps which are used in the exhaust systems of diesel engines, amongst other uses.

Diesel engines equipped with particulate traps, mounted in the exhaust stream, to "trap" or collect particulates in the exhaust to prevent their emission to the atmosphere are expected to be in greater use in the next few years.

Diesel engines running without particulate traps emit unburned hydrocarbons (HC), carbon monoxide (CO), nitrogen oxides ($NO_x$), and particulates, all of which are subject to current or proposed regulation. The problems of controlling these pollutants are compounded because there is a trade-off between particulates and nitrogen oxides: when the combustion conditions are modified to favor low nitrogen oxides emissions, particulates are increased. Particulate traps are employed to reduce the severity of the particulate emissions.

Diesel particulates, their effect and control, are at the center of much concern and controversy. Their chemistry and environmental impact present complex issues. Generally, the diesel particulate matter is principally solid particles of carbon and metal compounds with adsorbed hydrocarbons, sulphates and aqueous species. Among the adsorbed species are aldehydes and polycyclic aromatic hydrocarbons. Some of these organics have been reported to be potential carcinogens or mutagens. Unburned hydrocarbons are related to the characteristic diesel odour and include aldehydes such as formaldehyde and acrolein. The need to control nanoparticles is likely to lead to mandates requiring traps.

The use of diesel traps and the need to improve them has resulted in a great deal of research and a great number of patents and technical publications. The traps are typically constructed of metal or ceramic and are capable of collecting the particulates from the exhaust and withstanding the heat produced by oxidation of carbonaceous deposits which must be burned off at regular intervals.

This burning off, or regeneration, could occur by itself if the operating temperature of the trap were sufficiently high. However, in the typical situation, the exhaust temperature is not constantly high enough, and secondary measures such as electrically heating to raise the trap temperature or using a catalyst on the washcoat to reduce the combustion temperature of particulates, have not been fully successful.

The use of organometallic salts and complexes to improve the operation of diesel engine particulate traps is disclosed, for example, in U.S. Pat. No. 5,344,467 issued Sep. 6, 1994, which teaches the use of a combination of an organometallic complex and an antioxidant. The organometallic complex is soluble or dispersible in the diesel fuel and is derived from an organic compound containing at least two functional groups attached to a hydrocarbon linkage.

WO 99/36488 published Jul. 22, 1999 discloses fuel additive compositions which contain at least one iron-containing fuel-soluble or fuel-dispersible species in synergistic combination with at least one alkaline earth group metal-containing fuel-soluble or fuel-dispersible species. This combination of metallic additives is said to improve the operation of the diesel particulate filter traps.

WO 94/11467 published May 26, 1994 teaches a method to improve the operation of diesel traps through the use of a fuel additive comprising fuel-soluble compositions of a platinum group metal in effective amounts to lower the emissions of unburned hydrocarbons and carbon monoxide from the trap. The platinum group metals comprise platinum, palladium, rhodium or iridium.

EP 671205, EP 599717 and EP 575189 disclose the use of various cerium compounds in fuels.

A problem observed in connection with the formulation of diesel fuels having solubilised or colloidally dispersed metals such as metal oxides is the tendency to undergo phase separation upon storage, as evidenced by formation of haze or actual separation of layers. This problem is even more pronounced in connection with low sulphur diesel fuels which also contain a variety of additives.

The present invention is based upon a discovery that such fuels may be stabilised against such phase separation or haze formation by the addition of very small amounts of an oil-dispersible or oil-soluble compound having two or more contiguous polar head groups.

In accordance with this invention there have been discovered diesel fuel compositions stabilised against phase separation comprising a diesel fuel, a colloidally dispersed or solubilised metal catalyst compound for diesel particulate trap regeneration and an oil soluble or oil dispersible organic compound having a lipophilic hydrocarbyl chain having attached directly thereto at least two contiguous polar head functional groups, the organic compound being present in an amount effective to stabilise the metal catalyst compound against phase separation, wherein the metal catalyst compound comprises one or more inorganic or organic compounds or complexes of cerium, iron, calcium, magnesium, strontium, sodium, manganese and platinum or mixtures thereof, and wherein at least one of the contiguous polar head groups of the organic compound is a carboxylic acid or carboxylate group and the remainder are selected from carboxylic acid, carboxylate, ester or amide groups.

The organic compound is generally present in an amount of 5 to 1,000 ppm, preferably 10 to 1,000 ppm, more preferably 10 to 200 ppm, most preferably 10 to 50 ppm (weight) of compound per weight of diesel fuel composition in order to effectively stabilise the metal catalyst compound.

In this specification, the term 'contiguous polar head functional groups' is used to represent polar (functional chemical) groups which are separated by no more than three, preferably no more than two carbon atoms within the molecule.

The invention is particularly applicable to diesel fuel compositions which contain as catalysts for diesel particulate trap regeneration effective amounts of metallic compounds, typically sufficient to provide 1 to 200, 1 to 100, 1 to 20, 1 to 10, or 1 to 5 ppm metal (by weight) in the fuel, in the form of colloidally dispersed or solubilised inorganic or organic compounds or complexes. The metal catalyst compound preferably comprises one or more inorganic or organic compounds or complexes of cerium, iron, calcium, magnesium, strontium, sodium, manganese and platinum or mixtures thereof.

Prererably, the invention concerns metal catalyst compounds comprising:

(a) at least one of cerium oxide or an organic complex of cerium or both, or
(b) at least one of an iron oxide or an organic complex of iron or both, or
(c) mixtures thereof.

More preferably, compounds such as cerium oxide and iron oxide as well as other organometallic complexes of iron such as ferrocene, diferrocene, iron carboxylates or overbased iron soaps or salts such as iron sulphonates and iron naphthenates, or mixtures thereof can be employed. Other metal compounds include those of Ca, Mg, Sr, Na and particularly Mn and Pt, particularly overbased carboxylate soaps of these and the metal oxides, and hydroxide and carbonate salts (and mixtures thereof).

Most preferably, the composition metal catalyst compound comprises cerium or iron oxides or mixtures thereof.

The stabiliser compound of the present invention may be represented by the generalised formula A-C-B, where C represents a hydrocarbyl chain of Mn (number average molecular weight) 200-4,000, preferably 200-1,300, more preferably 200-1,000 such as 400-1,000, 700-1000 or 450-700.

The stabilisers may also be described in the following pictorial representation:

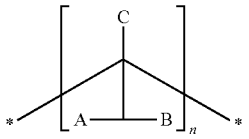

In the formula above, n may be 1-20, but is preferably 1-10, more preferably 1-5. When n is greater than 1, the stabiliser includes compounds of the following formulas, where "PIB" is polyisobutenyl, "PIBSA" is polyisobutenyl succinic anhydride and R is the lipophilic hydrocarbyl group:

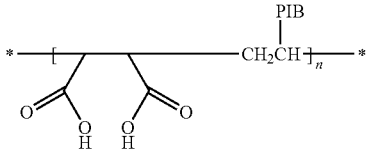

Hydrolysed poly(PIBSA)

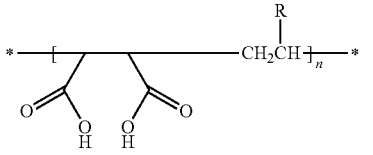

Hydrolysed Alternating Copolymers of (alpha-olefin-alt-maleic Anhydride)

This hydrocarbyl chain may be straight or branched, but branched hydrocarbyl chains are preferred because of their increased degree of solubility and preferably the hydrocarbyl chain is a polyisobutenyl group in the molecular weight ranges given above. In the aforesaid formula A and B represent at least two contiguous polar head functional groups attached directly to one end of the lipophilic C chain. At least one of A and B represents a carboxylic acid or carboxylate group. The other polar head groups may be selected from carboxylic acid, carboxylate, ester and amide groups. Where a group is an ester group, an ester of a simple lower primary or secondary alcohol, the alcohol having 1 to 22 carbon atoms, or an ester of a polyhydric alcohol having 2 to 20 carbon atoms and 2 to 5 hydroxyl groups, or an ester of a polyoxyalkylene compound or glycol such as polyethylene glycols and polypropylene glycols, these compounds having a molecular weight of 100-1,000 is preferred. An amide of an alkanolamine having 2 to 20 carbon atoms such as monoethanolamine or diethanolamine or other functionalised polyamines is preferred as an amide group.

Compounds with two contiguous groups that are capable of binding or otherwise coordinating to a metal or metal oxide moiety are known in the art as bidentate. By varying the nature of the carboxylate derivative used, the head grouping can be made to be tridentate, tetradentate and polydentate in surface binding ability.

A and B may represent the same or different functional groups. In a preferred embodiment A and B are both contiguous carboxylate residues, being either groups of the formula —COOH or ionized as $—(COO^-)_nM^{n+}$ where M may be a uni- or dipositively charged metal cation (ie, where n=1 or 2) or a quaternary ammonium cation. Typical examples of suitable quaternary ammonium cations are the ammonium ion itself, $NH_4^+$, and the following quaternary ammonium cations $R_4N^+$, $R_3NH^+$, $R_2NH_2^+$, $RNH_3^+$ derived from tertiary, secondary and primary amines respectively where R=H or a straight or branched alkyl chain or aromatic moiety containing from 1 to 22 carbon atoms.

Particularly preferred stabiliser additives for use in the composition of the present invention are polyisobutenyl succinic acid wherein the polyisobutenyl group has a Mn of 1,000, the monoisopropyl ester of the same polyisobutenyl succinic acid and polyisobutenyl succinic acid wherein the polyisobutenyl group has a molecular weight of 450.

Further embodiments of this invention comprise fuel compositions comprising the stabiliser compound, metal catalyst compound and one or more other fuel additive compounds, such as a lubricity enhancing additive, diesel detergent additive or a cold flow additive.

Still further embodiments comprise additive concentrate compositions containing 3 to 75% by weight of the stabiliser of this invention, in combination with the particulate trap metal catalyst compound, optionally in further combination with one or more other fuel additive compounds such as a lubricity enhancing additive, diesel detergent additive or a cold flow additive as described herein below.

A concentrate comprising the additive dispersed in carrier liquid (e.g. in solution) is convenient as a means of incorporating the additive. The concentrates of the present invention are convenient as a means for incorporating the additive into bulk oil such as distillate fuel, which incorporation may be done by methods known in the art. The concentrates may also contain other additives as required and preferably contain from 3 to 75 wt %, more preferably 3 to 60 wt %, and most preferably 10 to 50 wt % of the additive or additives preferably in solution in oil. Examples of carrier liquid are organic solvents including hydrocarbon solvents, for example petroleum fractions such as naphtha, kerosene, diesel and heater oil; aromatic hydrocarbons such as aromatic fractions, e.g. those sold under the 'SOLVESSO' trade name; alcohols and/or esters; and paraffinic hydrocarbons such as hexane and pentane and isoparaffins. Higher boiling paraffinic liquids are preferred. Alkylphenols, such as nonylphenol and 2,4-di-t-butylphenol either alone or in combination with any of the above have also been found to be particularly useful as carrier solvents. The carrier liquid must, of course, be selected having regard to its compatibility with the additive and with the fuel.

Further embodiments of the invention include:

the use, in a diesel fuel composition comprising a diesel fuel and the colloidally dispersed or solubilised metal catalyst compound as defined above, of the oil soluble or oil dispersible organic compound defined above to reduce the tendency of the diesel fuel and the colloidally dispersed or solubilised metal catalyst compound to form separate phases within the diesel fuel composition over time;

the use of the oil soluble or oil dispersible organic compound defined above, in an additive concentrate comprising the metal catalyst compound defined above, to improve the colloidal dispersability or solubility of the metal catalyst compound in diesel fuel; and a process for enhancing the oil dispersibility or solubility of the metal catalyst compound defined above, comprising the addition thereto of the oil soluble or oil dispersible organic compound defined above:

(a) either to a diesel fuel composition comprising a diesel fuel and the metal catalyst compound, (b) or, preferably, to an additive concentrate containing the metal catalyst compound, (c) or to both.

Examples of other stabiliser compounds are as follows wherein R is hydrocarbyl.

Betaines

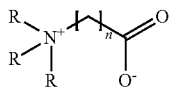

Amino Acids Derivatives (Zwitterions)

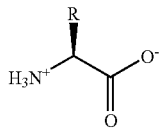

including acylated amino acid moieties

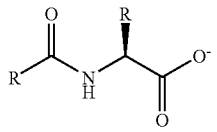

especially acylated aspartic and glutamic acid moieties

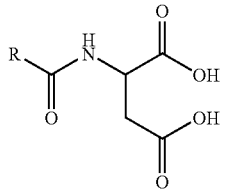

acylated aspartic acid

-continued

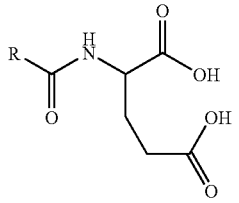

acylated glutamic acid

Glutamic acid derivatives are examples of the present invention where the contiguous polar head groups (COOH) are separated in space by three carbon atoms.

α-Hydroxy Acids

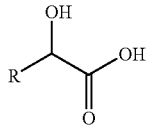

The fuel oil may be a petroleum-based fuel oil, suitably a middle distillate fuel oil, i.e. a fuel oil obtained in refining crude oil as the fraction between the lighter kerosene and jet fuels fraction and the heavy fuel oil fraction. Such distillate fuel oils generally boil above about 100° C. The fuel oil can comprise atmospheric distillate or vacuum distillate, or cracked gas oil or a blend in any proportion of straight run and thermally and/or catalytically cracked and/or hydroprocessed distillates. The most common petroleum-based fuel oils are kerosene, jet fuels and preferably diesel fuel oils.

The sulphur content of the fuel oil may be 2000 or less, preferably 500 or less, more preferably 50 or less, most preferably 10 or less, ppm by mass based on the mass of the fuel oil. The art describes methods for reducing the sulphur content of hydrocarbon middle distillate fuels, such methods including solvent extraction, sulphuric acid treatment, and hydrodesulphurisation.

Preferred fuel oils have a cetane number of at least 40, preferably above 45 and more preferably above 50. The fuel oil may have such cetane numbers prior to the addition of any cetane improver or the cetane number of the fuel may be raised by the addition of a cetane improver.

Advantageously, the fuel oils are those that have low solvency properties caused by low aromatic concentrations (e.g. below 30, below 20, below 15, below 10, or below 5, mass percent), and/or those that are required to operate at low temperatures such as at −5, −10, −15, or −20, ° C. or lower.

Other examples of fuel oils include jet-fuels; Fischer-Tropsch fuels; biofuels such as fuels made from vegetable matter such as rape seed methyl ester; and diesel/alcohol or diesel/water emulsions or solutions. Fischer-Tropsch fuels, also known as FT fuels, include those that are described as gas-to-liquid fuels and coal conversion fuels. To make such fuels, syngas ($CO+H_2$) is first generated and then converted to normal paraffins by a Fischer-Tropsch process. The normal paraffins may then be modified by processes such as catalytic cracking/reforming or isomerisation, hydrocracking and hydroisomerisation to yield a variety of hydrocarbons such as iso-paraffins, cyclo-paraffins and aromatic compounds. The resulting FT fuel can be used as such or in combination with other fuel components and fuel types such as those mentioned in this specification. Also suitable are fuels emulsified with water and alcohols, which contain suitable surfactants, and residual fuel oil used in marine diesel engines. WO-A-0104239; WO-A-0015740; WO-A-0151593; WO-A-9734969; and WO-155282 describe examples of diesel/water emulsions. WO-A-0031216; WO-A-9817745; and WO-A-024 8294 describe examples of diesel-ethanol emulsions/mixtures.

Preferred vegetable-based fuel oils are triglycerides of monocarboxylic acids, and these typically have the general formula shown below

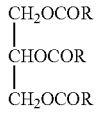

where R is an aliphatic radical of 10-25 carbon atoms which may be saturated or unsaturated.

Generally, such oils contain glycerides of a number of acids, the number and kind varying with the source vegetable of the oil. Suitable fuel oils also include mixtures of 1-100% by weight of vegetable oils or methylesters of fatty acid, with petroleum based diesel fuel oils.

Examples of oils and methyl ester derived fuel are tall oil, rapeseed oil, coriander oil, soyabean oil, cottonseed oil, sunflower oil, castor oil, olive oil, peanut oil, maize oil, almond oil, palm kernel oil, coconut oil, mustard seed oil, beef tallow and fish oils. Rapeseed oil, which is a mixture of fatty acids esterified with glycerol, is preferred as it is available in large quantities and can be obtained in a simple way by pressing from rapeseed.

Further preferred examples of vegetable-based fuel oils are alkyl esters, such as methyl esters, of fatty acids of the vegetable or animal oils. Such esters can be made by transesterification.

As lower alkyl esters of fatty acids, consideration may be given to the following, for example as commercial mixtures containing, for example: the ethyl, propyl, butyl and especially methyl esters of fatty acids with 12 to 22 carbon atoms, for example, mixtures of lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid or erucic acid, and rosin acid and isomers which have an iodine number from 50 to 180, especially 90 to 180. Mixtures with particularly advantageous properties are those which contain mainly, i.e. to at least 50 wt % methyl esters of fatty acids with 16 to 22 carbon atoms and 1, 2 or 3 double bonds. The preferred lower alkyl esters of fatty acids are the methyl esters of oleic acid, linoleic acid, linolenic acid and erucic acid.

Commercial mixtures of the stated kind are obtained for example by cleavage and esterification of natural fats and oils by their transesterification with lower aliphatic alcohols. For production of lower alkyl esters of fatty acids it is advantageous to start from fats and oils with high iodine number, such as, for example, sunflower oil, rapeseed oil, coriander oil, castor oil, soyabean oil, cottonseed oil, peanut oil or beef tallow. Lower alkyl esters of fatty acids based on a new variety of rapeseed oil, the fatty acid component of which is derived to more than 80 wt % from unsaturated fatty acids with 18 carbon atoms, are preferred.

Most preferred as a vegetable-based fuel oil is rapeseed methyl ester.

Where the fuel comprises the above-defined biofuels (either alone, or in combination with other fuels from other sources, such as petroleum-based fuels), it has been found that higher proportions of the stabiliser compound can be required to impart effective stability against phase separation. Thus, in such embodiments, the amount of the stabiliser compound should typically exceed 20 ppm weight (per weight of fuel), more preferably 25 to 200 ppm of stabiliser compound. This effect is particularly prevalent with lower alkyl esters of fatty acids, such as rapeseed and other vegetable oil methyl esters.

The additive compositions and/or the fuel compositions of the invention may additionally comprise one or more other fuel additives, or co-additives, as indicated above. Examples include other lubricity-enhancing compounds; cold flow improvers such as ethylene-unsaturated ester copolymers, hydrocarbon polymers, polar nitrogen compounds, alkylated aromatics, linear polymer compounds and comb polymers; detergents; corrosion inhibitors (anti-rust additives); dehazers; demulsifiers; metal deactivators; antifoaming agents; combustion improvers such as cetane improvers; co-solvents; package compatibilisers; reodorants; and metallic-based additives such as metallic combustion improvers.

The inventive diesel fuel compositions can contain other fuel additives which are well known to those of skill in the art. These include dyes, cetane improvers, rust inhibitors such as alkylated succinic acids and anhydrides, bacteriostatic agents, gum inhibitors, metal deactivators, demulsifiers, upper cylinder lubricants and anti-icing agents and antioxidants.

Stabilised compositions of this invention will preferably contain one or more of the various lubricity additives which are now commonly used in low sulphur fuels, i.e., fuels having less than 0.2 wt % sulphur, preferably less than 0.1 wt % such as 0.005 or 0.001 wt % sulphur or less. Such lubricity additives include monohydric or polyhydric alcohol esters of $C_2$-$C_{50}$ carboxylic acids such as glycerol monooleate, esters of polybasic acids with $C_1$-$C_5$ monohydric alcohols, esters of dimerized carboxylic acids, reaction products of polycarboxylic acids and epoxides such as 1,2-epoxyethane and 1,2-epoxypropane and lubricity additives derived from fatty acids such as vegetable oil fatty acid methyl esters, as well as fatty acid amides of monoethanolamine and diethanolamine.

Further examples are lubricity additives prepared by combining the aforesaid esters of $C_2$-$C_{50}$ carboxylic acids with an ashless dispersant comprising an acylated nitrogen compound having a hydrocarbyl substituent of at least 10 carbon atoms made by reacting an acylating agent with an amino compound, such as the reaction products of polyisobutenyl ($C_{80}$-$C_{500}$) succinic anhydride with ethylene polyamines having 3 to 7 amino nitrogen atoms.

Another example of lubricity additive chemistry are compounds of the following formula, described in WO 97/45507 and WO 02/02720:

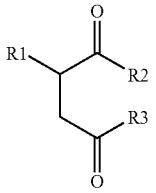

Where $R^1$ is a $C_{10-32}$ alkenyl group and $R^2$ and $R^3$ are $(—OCH_2CH_2)_nOH$, $(—OCH_2CHCH_3)_nOH$, or $—OCH_2CHOHCH_2OH$ in which n=1-10.

Other lubricity additives are combinations of the aforesaid esters with ethylene-unsaturated ester copolymers having, in addition to units derived from ethylene, units of the formula $$—CR^1R^2—CHR^3—$$

wherein $R^1$ represents hydrogen or methyl; $R^2$ represents $COOR^4$, wherein $R^4$ represents an alkyl group having from 1 to 9 carbon atoms which is straight chain or, if it contains 2 or more carbon atoms, branched, or $R^2$ represents $OOCR^5$, wherein $R^5$ represents $R^4$ or H; and $R^3$ represents H or $COOR^4$. Examples are ethylene-vinyl acetate and ethylene-vinyl propionate and other copolymers where there is present 5-40% of the vinyl ester.

As an alternative to the above described esters, or in combination therewith, the lubricity additive may comprise one or more carboxylic acids of the types disclosed in relation to the ester lubricity additives. Such acids may be mono- or polycarboxylic, saturated or unsaturated, straight or branched chain and may be generalised by the formula $R^1(COOH)_x$ where x is 1-4 and $R^1$ is a $C_2$ to $C_{50}$ hydrocarbyl. Examples are capric, lauric, myristic, palmitic, oleic, elaidic, palmitoleic, petaoselic, ricinoleic, linoleic, linolenic, eicosanic, tall oil fatty and dehydrated castor oil fatty acids, and rosin acids and isomers and mixtures thereof. The polycarboxylic acid may be a dimer acid such as that formed by dimerization of unsaturated fatty acids such as linoleic or oleic acid.

Other lubricity additives are hydroxy amines of the formula

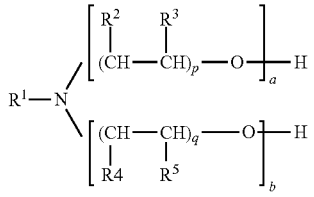

where $R^1$ is an alkenyl radical having one or more double bonds or an alkyl radical and containing from 4 to 50 carbon atoms, or a radical of the formula

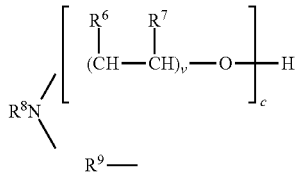

where each of $R^2$, $R^3$, $R^4$, $R^5$, $R^6$ and R 7 is independently hydrogen or a lower alkyl radical; $R^8$ is an alkenyl radical having one or more double bonds or an alkyl radical and containing from 4 to 50 carbon atoms; $R^9$ is an alkylene radical containing from 2 to 35, e.g. 2 to 6, carbon atoms; each of p, q and v is an integer between 1 and 4; and each of a, b and c may be 0, providing that at least one of a, b or c is an integer between 1 and 75.

Other lubricity additives are ester, amine and amine salt derivatives of salicylic acid and alkylated salicylic acids.

The additives of the invention may also be used in combination with diesel performance additives such as silicon-containing anti-foam agents such as siloxane block copolymers or cetane improvers such as 2-ethyl hexyl nitrate.

The additives of the present invention may also be used in combination with an appropriate carrier liquid or organic solvent. Examples of carrier liquid are organic solvents including hydrocarbon solvents, for example petroleum fractions such as naphtha, kerosene, diesel and heater oil; aromatic hydrocarbons such as aromatic fractions, e.g. those sold under the 'SOLVESSO' tradename; paraffinic hydrocarbons such as hexane and pentane and isoparaffins, e.g., those sold under the 'ISOPAR' tradename; and oxygenated solvents such as alcohols. The carrier liquid must, of course, be selected having regard to its compatibility with the additive and with the fuel.

The stabiliser composition can be

1. Preferably added to the DPF (diesel particulate filter) additive composition prior to doping the mixture into the fuel.
2. Added to the fuel separately before or after addition of the DPF additive.
3. Added to any typical fuel additive composition, e.g., lubricity improver, detergent, cold flow improver, corrosion inhibitor, antistatic or mixtures thereof prior to doping the mixture into the fuel.
4. Added to the fuel separately before or after addition of any typical fuel additive composition.

The additive compositions of the invention, with or without diluent or solvent, may be incorporated into bulk fuel oil by methods such as those known in the art. If co-additives are required, they may be incorporated into the bulk fuel oil at the same time as the additives of the invention or at a different time.

The invention is further illustrated by the following examples.

EXAMPLES

Synthesis

Example 1

Preparation of $PIB_{1000}$ (Polyisobutenyl Mn 1000) Succinic Acid

[Stabiliser A]

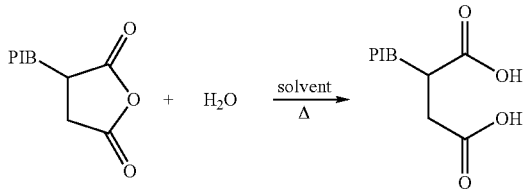

$PIB_{1000}SA$ (succinic anhydride) (10 g, 9.5 mmol), toluene (50 ml) and deionised water (15 ml, excess) were heated with stirring under reflux (~85° C.) for 6 hours.

After cooling, the organic phase was separated and dried over anhydrous $MgSO_4$. After filtration, the solvent was removed in vacuo at low temperature, giving a product which was used directly.

| | |
|---|---|
| Infrared: | $\nu_{co}$ 1714 (free acid) $cm^{-1}$. |
| % C, H, N: | C, 80.8; H, 12.5; N, <0.1%. |
| TAV = 1.96 Meq/g; TAN = 110 mg KOH/g. | |

Example 2

Preparation of Monoisopropyl Ester of $PIB_{1000}$ Succinic Acid

[Stabiliser B]

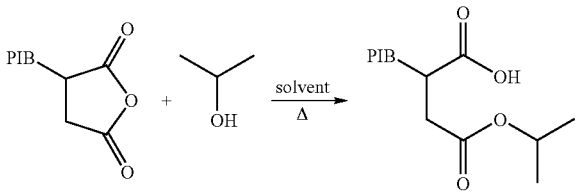

$PIB_{1000}SA$ (10 g, 9.5 mmol), toluene (50 ml) and isopropanol (50 ml, excess) were heated with stirring under reflux (~85° C.) for 6 hours.

After cooling, the solvent mixture was removed in vacuo at low temperature, giving a partially esterified product which was used directly.

| | |
|---|---|
| Infrared: | $\nu_{co}$ 1713 (free acid); 1734 (ester) $cm^{-1}$. |
| % C, H, N: | C, 81.0; H, 12.5; N, 0.2%. |
| TAV = 1.37 Meq/g; TAN = 76 mg KOH/g. | |

Example 3

Preparation of $PIB_{450}$ (Polyisobutenyl Mn 450) Succinic Acid

[Stabiliser C]

$PIB_{450}SA$ (50 g), Isopar L, a paraffinic solvent, (150 ml) and water (4 ml, excess) were heated with stirring under a reflux (~120° C.) for 12 hours.

After cooling, the organic phase was separated and dried over anhydrous $MgSO_4$. After filtration, the solvent mixture was removed in vacuo at low temperature, giving a product which was used directly.

The characteristics of the fuels tested are given below:

Diesel Fuels Used in Examples

Diesel Fuel A: German Low Sulphur

| | |
|---|---|
| CFPP (° C.) | −10 |
| Cloud Point (° C.) | −9 |
| Density @15 deg. C. (kg/l) | 0.827 |
| Sulphur | <10 ppm |
| D86 Distillation (° C.) | |
| IBP | 179 |
| 10% | 198 |
| 50% | 248 |
| 95% | 340 |
| FBP | 353 |

Diesel Fuel B: German Low Sulphur

| | |
|---|---|
| CFPP (° C.) | −9 |
| Cloud Point (° C.) | −8 |
| Density @15 deg. C. (kg/l) | 0.831 |
| Sulphur | <10 ppm |
| D86 Distillation (° C.) | |
| IBP | 174 |
| 10% | 204 |
| 50% | 264 |
| 95% | 347 |
| FBP | 359 |

Diesel Fuel C: Spanish 300 ppm Sulphur

| | |
|---|---|
| KV@40 C. (cSt) | 3.133 |
| Sulphur content (ppm) | 300 |
| Density@15 C. Kg/liter | 833.9 |
| Cloud Point (° C.) | +1 |
| IBP (° C.) | 183.7 |
| 10% Recovery | 224.3 |
| 50% Recovery | 281 |
| 95% Recovery | 353.5 |
| FBP | 368.9 |

Diesel Fuel D: Swedish Class 1

| Test | Result | Units |
|---|---|---|
| Cloud point (Auto) | −40 | ° C. |
| CFPP | −40 | ° C. |
| kV @ 40° C. (Auto) | 1.574 | cSt |
| Density @ 15° C. | 817.6 | $Kg/m^3$ |
| Sulphur | 9 | mg/kg |
| Distillation D86 | | |
| IBP | 190.9 | ° C. |
| 10% | 208.8 | ° C. |
| 50% | 233.3 | ° C. |
| 95% | 278.8 | ° C. |
| FBP | 290.1 | ° C. |

Diesel Fuel E: Shell Class 1 diesel fuel.

Diesel Fuel F: a further Class 1 diesel fuel.

Stability Examples

Example 4

Investigation of Stability of Colloidal Cerium DPF System in German Low Sulphur (<10 ppm) Diesel Fuels A and B at 80° C.

Tables 1 and 2 detail stability results for the colloidal cerium-based DPF additive Eolys®, a cerium containing oil fuel additive marketed by "Rhodia Electronics and Catalysis", a Rhodia Group subsidiary, in low sulphur diesel fuels in the presence of various lubricity improver additive chemistries and in the presence of percentage levels of biodiesel (rapeseed oil methyl ester—RME) respectively. The stability test involved the separate addition of the additive(s) to the respective fuel using normal laboratory blending practices, and thereafter visually observing the blended fuel composition for phase separation and general appearance whilst being stored at 80° C.

The results demonstrate that the cerium-based colloid is fundamentally unstable in low sulphur diesel fuel and evidence of gross phase separation of insoluble precipitates is seen within 1 day during storage at 80° C., even in the absence of the lubricity additive or biodiesel.

The results also show that the RME and the various lubricity improver additives are unlikely to improve the stability of the metal catalyst compound to levels required to ensure safe field operation.

TABLE 1

Stability of Colloidal Cerium DPF Additive in German Low Sulphur Diesel Fuel A in the Presence of Representative Types of Lubricity Improver Chemistry

| Fuel | Eolys ® (ppm Ce) | Lubricity Improver Chemistry I (ppm) | Lubricity Improver Chemistry II (ppm) | Lubricity Improver Chemistry III (ppm) | Lubricity Improver Chemistry IV (ppm) | RME (%) | day 1 | day 2 | day 4 (end) |
|---|---|---|---|---|---|---|---|---|---|
| Fuel A | 25 | | | | | | phase sep. | phase sep. | phase sep. |
| Fuel A | 25 | 200 | | | | | phase sep. | phase sep. | phase sep. |
| Fuel A | 25 | 400 | | | | | phase sep. | phase sep. | phase sep. |
| Fuel A | 25 | | 200 | | | | phase sep. | phase sep. | phase sep. |
| Fuel A | 25 | | 400 | | | | phase sep. | phase sep. | phase sep. |
| Fuel A | 25 | | | 200 | | | phase sep. | phase sep. | phase sep. |
| Fuel A | 25 | | | 400 | | | phase sep. | phase sep. | phase sep. |
| Fuel A | 25 | | | | 200 | | phase sep. | phase sep. | phase sep. |
| Fuel A | 25 | | | | 400 | | phase sep. | phase sep. | phase sep. |
| Fuel A | 25 | | | | | 5% | phase sep. | phase sep. | phase sep. |
| Fuel A | 25 | | | | | 30% | hazy | phase sep. | phase sep. |

RME = Rapeseed Methyl Ester (biodiesel)

TABLE 2

Stability of Colloidal Cerium DPF Additive in German Low Sulphur Diesel Fuel B in the Presence of Representative Types of Lubricity Improver Chemistry

| Fuel | Eolys ® (ppm Ce) | Lubricity Improver Chemistry I (ppm) | Lubricity Improver Chemistry II (ppm) | Lubricity Improver Chemistry III (ppm) | Lubricity Improver Chemistry IV (ppm) | RME (%) | day 1 | day 2 | day 4 (end) |
|---|---|---|---|---|---|---|---|---|---|
| Fuel B | 25 | | | | | | phase sep. | phase sep. | phase sep. |
| Fuel B | 25 | 200 | | | | | phase sep. | phase sep. | phase sep. |
| Fuel B | 25 | 400 | | | | | phase sep. | phase sep. | phase sep. |
| Fuel B | 25 | | 200 | | | | phase sep. | phase sep. | phase sep. |
| Fuel B | 25 | | 400 | | | | phase sep. | phase sep. | phase sep. |
| Fuel B | 25 | | | 200 | | | phase sep. | phase sep. | phase sep. |
| Fuel B | 25 | | | 400 | | | phase sep. | phase sep. | phase sep. |
| Fuel B | 25 | | | | 200 | | phase sep. | phase sep. | phase sep. |
| Fuel B | 25 | | | | 400 | | phase sep. | phase sep. | phase sep. |
| Fuel B | 25 | | | | | 5% | phase sep. | phase sep. | phase sep. |
| Fuel B | 25 | | | | | 30% | hazy | phase sep. | phase sep. |

Example 5

Investigation of Stability of Colloidal Cerium DPF Additive in the Presence of Commercial Lubricity Additives in Diesel Fuel C (300 ppm Sulphur) and Fuel D (Swedish Class 1, <10 ppm Sulphur) at 80° C.

It may be observed from Table 3 that the cerium-based DPF additive (Eolys®) is fundamentally unstable with respect to precipitation/phase separation in the presence of various lubricity additive chemistries in these two different diesel fuels. The same test protocol of separate addition of the additives to the fuel was followed.

This instability of the cerium additive at two concentrations (25 ppm and 250 ppm respectively) is only mitigated in the presence of very high levels (200-1000 ppm) of PIBSA-PAM, a polyisobutenyl succinimide diesel detergent, which contains one imide polar head group per lipophilic chain (ie. not an example according to the invention.)

TABLE 3

Stability of Cerium-based DPF Additives at 80° C. in the Presence of Some Lubricity Additives in Diesel Fuels C and D

| Diesel | Eolys ® (ppm Ce) | Lubricity Improver Chemistry I (ppm) | Lubricity Improver Chemistry II (ppm) | Lubricity Improver Chemistry IV (ppm) | PIBSA-PAM (ppm) | 1 hr. | day 1 | day 4 | day 5 | day 7 (end) |
|---|---|---|---|---|---|---|---|---|---|---|
| Fuel C | 250 | 200 | | | | clear | hazy | phase sep. | phase sep. | phase sep. |
| Fuel C | 250 | 200 | | | 200 | clear | clear | clear | clear | clear |
| Fuel C | 250 | 600 | | | 600 | clear | clear | hazy | hazy | hazy |
| Fuel C | 250 | 600 | | | 800 | clear | clear | clear | clear | slightly hazy |
| Fuel C | 250 | 600 | | | 1000 | clear | clear | clear | clear | clear |
| Fuel C | 25 | | | | | clear | clear | clear | hazy | phase sep. |
| Fuel C | 25 | 200 | | | | clear | hazy | hazy | hazy | phase sep. |
| Fuel C | 25 | 200 | | | 50 | clear | hazy | hazy | hazy | slightly hazy |
| Fuel C | 25 | 200 | | | 200 | clear | clear | clear | clear | clear |
| Fuel C | 25 | 200 | | | 400 | clear | clear | clear | clear | clear |
| Fuel C | 25 | | | 200 | | hazy | phase sep. | phase sep. | phase sep. | phase sep. |
| Fuel D | 25 | 200 | | | | clear | clear/hazy? | clear | sl phase sep. | phase sep. |
| Fuel D | 25 | | 200 | | | clear | clear | phase sep. | phase sep. | phase sep. |
| Fuel D | 25 | | | 200 | | clear | clear/hazy? | phase sep. | phase sep. | phase sep. |

Example 6

Improved Stability of Colloidal Cerium in the Presence of Lubricity Additives when Using Stabilisers of the Present Invention (Part I)

Results given in Table 4 indicate the significantly improved stability of the colloidal DPF system in static storage at 80° C. in diesel fuel C in the presence of a lubricity improver when using low levels of the stabiliser molecules of the present invention (Stabilisers A and B from Examples 1 and 2 respectively).

Between 50-100 ppm of Stabiliser B is able to stabilise the Ce-based composition up to 7 days. Stabiliser A at 50-100 ppm is able to stabilise the similar composition for up to 12 days versus the control samples which exhibit the onset of phase separation from initial sample blending. Both A and B are capable of stabilizing the compositions to such an extent that clear compositions are formed, in some cases for extended periods (and particularly with the preferred stabiliser A). In comparison, low levels of PIBSA-PAM (10-100 ppm), a polyisobutenyl succinimide diesel detergent, which contains one imide polar head group per lipophilic chain, does not provide sufficient stabilization to form clear compositions.

Furthermore, the significantly-improved stability performance of the stabiliser molecule A versus the unreacted starting material, PIBSA, at similar concentration indicates the effectiveness of the present invention in stabilising the cerium colloid in the presence of the lubricity improver additive I.

TABLE 4

Improved Stability of Cerium-based DPF Additives at 80° C. in the Presence of Lubricity Improver in Diesel Fuel C When Using Stabilising Compositions

| Eolys ® (ppm Ce) | Lubricity Improver Chemistry I (ppm) | Stabiliser A (ppm) | Stabiliser B (ppm) | PIBSA-PAM (ppm) | PIBSA (ppm) | Day 0 | Day 3 | Day 4 | Day 5 | Day 6 | Day 7 | Day 10 | Day 11 | Day 12 | Day 13 | Day 14 |
|---|---|---|---|---|---|---|---|---|---|---|---|---|---|---|---|---|
| 25 | 200 | | | | | hazy | PS | PS | PS | PS | PS | PS | PS | PS | PS | PS |
| 25 | 200 | 10 | | | | clear | clear | clear | v s haze | s haze | hazy | v hazy | v hazy | v hazy | s PS | s PS |
| 25 | 200 | 50 | | | | clear | clear | clear | clear | clear | clear | clear | clear | clear | hazy | PS |
| 25 | 200 | 100 | | | | clear | clear | clear | clear | clear | clear | clear | clear | clear | PS | PS |
| 25 | 200 | | 10 | | | hazy | PS | PS | PS | PS | PS | PS | PS | PS | PS | PS |
| 25 | 200 | | 50 | | | clear | clear | clear | clear | v s haze | hazy | v hazy | PS | PS | PS | PS |
| 25 | 200 | | 100 | | | clear | clear | clear | clear | clear | clear | PS | PS | PS | PS | PS |
| 25 | 200 | | | 10 | | v hazy | PS | PS | PS | PS | PS | PS | PS | PS | PS | PS |
| 25 | 200 | | | 50 | | hazy | v hazy | v hazy | v hazy | v hazy | v hazy | s PS | s PS | s PS | s PS | s PS |
| 25 | 200 | | | 100 | | s haze | hazy | hazy | hazy | hazy | hazy | v hazy | v hazy | v hazy | v hazy | v hazy |
| 25 | 200 | | | | 10 | hazy | v hazy | PS | PS | PS | PS | PS | PS | PS | PS | PS |
| 25 | 200 | | | | 50 | clear | clear | clear | s haze | hazy | s PS | PS | PS | PS | PS | PS |
| 25 | 200 | | | | 100 | clear | clear | clear | clear | clear | clear | PS | PS | PS | PS | PS |

PS = phase separation, v = very, s = slight

Example 7

Improved Stability of Colloidal Cerium in the Presence of Commercial Lubricity Additives when Using Stabilisers of the Present Invention (Part II)

Table 5 gives further stability data for the stabilised Ce colloid, Eolys® in the presence of various lubricity additives.

It may be seen that 35-50 ppm of the stabiliser C (from Example 3) is able to stabilise Eolys® for up to 8 days static storage at 80° C. in the presence of large amounts (200 ppm) of lubricity additives I and IV, compared to control samples. The same stabiliser molecule at 50 ppm is able to control the stability of the Ce colloid in the presence of lubricity improver II for up to 5 days.

The various sample controls of Ce colloid and lubricity improver (without stabiliser present) exhibit haze formation and/or phase separation within 1 day. Likewise, the unreacted starting material, PIBSA, shows lesser ability to stabilise the composition against phase separation.

TABLE 5

Improved Stability of Cerium-based DPF Additives at 80° C. in the Presence of Some Commercial Lubricity Additives When Using Stabilising Compositions

| Fuel | Eolys ® (ppm Ce) | Lubricity Improver Chemistry I (ppm) | Lubricity Improver Chemistry II (ppm) | Lubricity Improver Chemistry IV (ppm) | Stabi-liser C (ppm) | PIBSA (ppm) | Day 0 | Day 1 | Day 2 | Day 3 | Day 4 | Day 5 | Day 6 | Day 7 | Day 8 |
|---|---|---|---|---|---|---|---|---|---|---|---|---|---|---|---|
| Fuel C | 25 | | | | | | clear | PS | — | — | PS | PS | PS | PS | PS |
| Fuel C | 25 | 200 | | | | | v s haze | hazy | — | — | PS | PS | PS | PS | PS |
| Fuel C | 25 | 200 | | | 10 | | clear | clear | — | — | v hazy | s PS | s PS | PS | PS |
| Fuel C | 25 | 200 | | | 20 | | clear | clear | — | — | clear | clear | hazy | PS | PS |
| Fuel C | 25 | 200 | | | 35 | | clear | clear | — | — | clear | clear | clear | clear | clear |
| Fuel C | 25 | 200 | | | 50 | | clear | clear | — | — | clear | clear | clear | clear | clear |
| Fuel C | 25 | 200 | | | | 10 | v s haze | hazy | — | — | PS | PS | PS | PS | PS |
| Fuel C | 25 | 200 | | | | 20 | clear | v s haze | — | — | PS | PS | PS | PS | PS |
| Fuel C | 25 | 200 | | | | 35 | clear | clear | — | — | clear | v hazy | PS | PS | PS |
| Fuel C | 25 | 200 | | | | 50 | clear | clear | — | — | clear | hazy | PS | PS | PS |
| Fuel C | 25 | | 200 | | | | v hazy | PS | — | — | PS | PS | PS | PS | PS |
| Fuel C | 25 | | 200 | | 10 | | s hazy | hazy | — | — | PS | PS | PS | PS | PS |
| Fuel C | 25 | | 200 | | 20 | | v s haze | v s haze | — | — | PS | PS | PS | PS | PS |
| Fuel C | 25 | | 200 | | 35 | | clear | clear | — | — | v hazy | PS | PS | PS | PS |
| Fuel C | 25 | | 200 | | 50 | | clear | clear | — | — | clear | clear | hazy | PS | PS |

TABLE 5-continued

Improved Stability of Cerium-based DPF Additives at 80° C. in the Presence of Some Commercial Lubricity Additives When Using Stabilising Compositions

| Fuel | Eolys ® (ppm Ce) | Lubricity Improver Chemistry I (ppm) | Lubricity Improver Chemistry II (ppm) | Lubricity Improver Chemistry IV (ppm) | Stabi-liser C (ppm) | PIBSA (ppm) | Day 0 | Day 1 | Day 2 | Day 3 | Day 4 | Day 5 | Day 6 | Day 7 | Day 8 |
|---|---|---|---|---|---|---|---|---|---|---|---|---|---|---|---|
| Fuel C | 25 | | 200 | | | 10 | v hazy | PS | — | — | PS | PS | PS | PS | PS |
| Fuel C | 25 | | 200 | | | 20 | v hazy | PS | — | — | PS | PS | PS | PS | PS |
| Fuel C | 25 | | 200 | | | 35 | hazy | PS | — | — | PS | PS | PS | PS | PS |
| Fuel C | 25 | | 200 | | | 50 | hazy | s PS | — | — | PS | PS | PS | PS | PS |
| Fuel C | 25 | | | 200 | | | clear | PS | — | — | PS | PS | PS | PS | PS |
| Fuel C | 25 | | | 200 | 10 | | clear | clear | — | — | PS | PS | PS | PS | PS |
| Fuel C | 25 | | | 200 | 20 | | clear | clear | — | — | clear | clear | hazy | PS | PS |
| Fuel C | 25 | | | 200 | 35 | | clear | clear | — | — | clear | clear | clear | clear | clear |
| Fuel C | 25 | | | 200 | 50 | | clear | clear | — | — | clear | clear | clear | clear | clear |
| Fuel C | 25 | | | 200 | | 20 | clear | clear | — | — | PS | PS | PS | PS | PS |
| Fuel C | 25 | | | 200 | | 35 | clear | clear | — | — | PS | PS | PS | PS | PS |
| Fuel C | 25 | | | 200 | | 50 | clear | clear | — | — | clear | PS | PS | PS | PS |

Example 8

Improved Stability of Colloidal Metal Oxide DPF Additives in Fuel D when Using Stabilisers of the Present Invention (Part III)

The results given in the Table 6 indicate the stabilising effect of Stabiliser A from Example 1 on a colloidal mixed cerium oxide and iron oxides additive, 'Eolys® 176', in fuel compositions comprising petroleum-derived diesel fuel D and the biofuel fatty acid methyl ester ('FAME'). In Table 6, the treat rates shown for the CeFe additive are ppm (weight) of total metal in the fuel.

TABLE 6

| Fuel Blend | Additives | Stability (days) |
|---|---|---|
| 5% FAME in fuel D composition | 10 ppm CeFe | 1 |
| | 10 ppm CeFe + 10 ppm stabiliser A | 1 |
| | 10 ppm CeFe + 25 ppm stabiliser A | 2 |
| | 10 ppm CeFe + 50 ppm stabiliser A | 4 |
| | 10 ppm CeFe + 75 ppm stabiliser A | 5 |
| | 10 ppm CeFe + 100 ppm stabiliser A | 5 |
| | 10 ppm CeFe + 200 ppm LI-V | 1 |
| | 10 ppm CeFe + 200 ppm LI-VI | 1 |
| 2% FAME in fuel D composition | 10 ppm CeFe | 1 |
| | 10 ppm CeFe + 10 ppm stabiliser A | 1 |
| | 10 ppm CeFe + 25 ppm stabiliser A | 2 |
| | 10 ppm CeFe + 50 ppm stabiliser A | 5 |
| | 10 ppm CeFe + 75 ppm stabiliser A | 12 |
| | 10 ppm CeFe + 100 ppm stabiliser A | 5 |
| | 10 ppm CeFe + 200 ppm LI-V | 1 |
| | 10 ppm CeFe + 200 ppm LI-VI | 1 |

It may be observed that addition of moderate amounts (25-75 ppm) of stabiliser A can markedly improve the stability of the colloidal metallic additive towards phase separation in the presence of the biofuel FAME, compared to the control situation with no stabiliser present.

Moreover, it may be seen that lubricity improver ('LI') chemistry types V and VI* offer no stabilising effect in this system.

Example 9

Improved Stabilisation Effect from Adding Stabiliser of the Present Invention Directly into the Colloidal Metal Catalyst Additive Concentrate, Prior to Addition to the Fuel Table 7 indicates the excellent stability that may be achieved by adding Stabiliser A from Example 1 directly into a stock solution of Eolys® 176, prior to doping the mixture into either Class 1 diesel fuel E or a fuel composition comprising fuel E and the biofuel fatty acid methyl ester ('FAME').

The results indicate the markedly improved stability that may be achieved from adding the stabiliser moiety directly into the colloidal metal catalyst concentrate prior to doping the mixtures into the fuel. The results may also be compared to those obtained from adding the stabiliser and colloidal DPF additive separately into a fuel composition comprising petroleum-derived diesel fuel and the biofuel fatty acid methyl ester ('FAME') (previous Example 8 above). It is believed that the pre-addition of the stabiliser to the metal additive concentrate causes the re-organisation of the colloidal metal complex in such a way that its oil soluble or oil dispersible character is substantially improved, leading to better performance when subsequently blended into the fuel.

TABLE 7

| Fuel Blend | Additives | Stability (days) |
|---|---|---|
| Class I diesel fuel | Separate blending into fuel | |
| | 25 ppm Ce | 1 |
| | 10 ppm CeFe | 2 |
| | 25 ppm Ce + 25 ppm Stabiliser A | 4 |
| | 25 ppm Ce + 50 ppm Stabiliser A | 5 |
| | 10 ppm CeFe + 25 ppm Stabiliser A | 5 |
| | 10 ppm CeFe + 50 ppm Stabiliser A | 15 |
| | Pre-blend of stabiliser into concentrate | |
| | 25 ppm Ce + 25 ppm Stabiliser A | 5 |
| | 25 ppm Ce + 50 ppm Stabiliser A | 15 |
| | 10 ppm CeFe + 25 ppm Stabiliser A | 10 |
| | 10 ppm CeFe + 50 ppm Stabiliser A | 15 |

TABLE 7-continued

| Fuel Blend | Additives | Stability (days) |
|---|---|---|
| 2% FAME in fuel composition | 10 ppm CeFe | 1 |
| | Pre-blend of stabiliser into concentrate | |
| | 10 ppm CeFe + 25 ppm Stabiliser A | 16 |
| | 10 ppm CeFe + 50 ppm Stabiliser A | 5 |
| | 10 ppm CeFe + 75 ppm Stabiliser A | 5 |
| | 10 ppm CeFe + 100 ppm Stabiliser A | 15 |
| 5% FAME in fuel composition | 10 ppm CeFe | 1 |
| | Pre-blend of stabiliser into concentrate | |
| | 10 ppm CeFe + 25 ppm Stabiliser A | 10 |
| | 10 ppm CeFe + 50 ppm Stabiliser A | 12 |
| | 10 ppm CeFe + 75 ppm Stabiliser A | 16 |
| | 10 ppm CeFe + 100 ppm Stabiliser A | 9 |

Example 10

Engine Test Results: Effect of Adding Stabiliser of the Present Invention into a Peugeot 307 Vehicle Fuel Tank The following Tables 8 and 9 give analytical results for Ce and Fe from samples obtained from the fuel tank of a Peugeot 307 car operated on (i) the mixed cerium and iron additive described in the previous two examples, and (ii) the cerium-only additive described in earlier examples, when used in Fuel F.

This Peugeot car was equipped (as standard factory fit) with a separate on-board tank for storage of a diesel particulate trap additive concentrate, this additive being introduced into the fuel contained in the tank of the car under the control of the on-board engine management system, to achieve the regeneration of the particulate trap. In these tests, the factory-filled additive was replaced by untreated test fuel (ie. containing no additive) to avoid subsequent interference in the test, and the fuel tank filled with test fuel already comprising the mixed cerium and iron additive and stabiliser A previously described, these additives having been added separately to the fuel. The stability of the fuel—additive mixture in the car fuel tank was thereafter assessed by analysis at periodic intervals during the running of the vehicle. At each assessment, sampling from both the top and bottom of the tank fuel gave an indication of the degree of phase separation and/or settlement of the metal additive from the fuel during the normal running of the vehicle.

In each table, the test fuel contained 25 ppm (weight) of stabiliser A and additionally contained a constant level of lubricity additive LI-I.

TABLE 8

| mixed cerium and iron additive | | |
|---|---|---|
| Test sample | Ce (ppm) | Fe (ppm) |
| Initial sample | 0.1 | 0.5 |
| One hour in test, top tank | 6.1 | 2.7 |
| One hour in test, bottom tank | 6 | 2.7 |
| Halfway through test, top tank | 6.1 | 2.8 |
| Halfway through test, bottom tank | 5.8 | 2.7 |
| End of test + 1 hour | 5.2 | 2.4 |
| After fuel drained | 5.3 | 2.5 |

The results in Table 8 demonstrate the maintenance of equivalent levels of metals throughout the fuel tank during the test, consistent with effective stabilization of the metal additive within the fuel.

TABLE 9

| cerium-only additive | |
|---|---|
| Test sample | |
| | Ce (ppm) with Stabiliser A |
| Initial sample | 21 |
| One hour in test, top tank | 22 |
| One hour in test, bottom tank | 22 |
| Halfway through test, top tank | 21 |
| Halfway through test, bottom tank | 21 |
| End of test + 1 hour | 16 |
| After fuel drained | 22 |
| | Ce (ppm) without Stabiliser A |
| Initial sample | 0.5 |
| One hour in test, top tank | 0.5 |
| One hour in test, bottom tank | 0.5 |
| Halfway through test, top tank | 0.5 |
| Halfway through test, bottom tank | 0.5 |
| End of test + 1 hour | 0.5 |
| After fuel drained | 0.5 |

In Table 9, the presence of stabiliser A again leads to maintenance of metal distribution within the tank, in contrast to the control experiment lacking stabiliser A.

What is claimed is:

1. A diesel fuel composition comprising a diesel fuel, a colloidally dispersed or solubilised metal catalyst compound for diesel particulate trap regeneration and 10 to 1,000 ppm of an oil soluble or oil dispersible organic compound having a lipophilic hydrocarbyl chain having attached directly thereto at least two contiguous polar head functional groups, wherein the metal catalyst compound consists essentially of (a) one or more inorganic or organic compounds or complexes of sodium, manganese and platinum or (b) a mixture of inorganic or organic compounds or complexes of iron and one or more inorganic or organic compounds or complexes of sodium, manganese and platinum, and wherein at least one of the contiguous polar head groups of the organic compound is a carboxylic acid or carboxylate group, and the remainder are selected from carboxylic acid, carboxylate, ester or amide groups.

2. The composition of claim 1 wherein the metal catalyst compound comprises at least one iron oxide or an organic complex of iron.

3. The composition of claim 1 wherein the hydrocarbyl chain is a polyisobutenyl of Mn 200-4,000.

4. The composition of claim 1 wherein the remainder of the contiguous polar head groups of the organic compound are selected from carboxylic acid, carboxylate or ester groups.

5. The composition of claim 1 wherein at least one of the contiguous polar head groups is an ester of a primary or secondary alcohol having 1 to 22 carbon atoms, an ester of a polyoxyalkylene compound or a polyhydric alcohol having 2 to 5 hydroxyl groups.

6. The composition of claim further comprising a lubricity additive.

7. The composition of claim 1 further comprising a cold flow additive.

8. The composition of claim 1 further comprising a diesel detergent additive.

9. The composition of claim 1 wherein the metal catalyst compound comprises an iron oxide.

10. The composition of claim 1 wherein the diesel fuel contains 2000 ppm or less of sulphur.

* * * * *

UNITED STATES PATENT AND TRADEMARK OFFICE

CERTIFICATE OF CORRECTION

PATENT NO. : 8,147,568 B2
APPLICATION NO. : 10/932462
DATED : April 3, 2012
INVENTOR(S) : Rinaldo Caprotti and Russell M. Thompson It is certified that error appears in the above-identified patent and that said Letters Patent is hereby corrected as shown below:

Col. 22, Line 57,
In claim 6, line 1, after "claim" insert -- 1 --.

Signed and Sealed this
Eighth Day of May, 2012

David J. Kappos

David J. Kappos
*Director of the United States Patent and Trademark Office*